US005615812A

United States Patent [19]

Martin

[11] Patent Number: 5,615,812

[45] Date of Patent: Apr. 1, 1997

[54] CONVERTIBLE PACKING FRAME

[76] Inventor: Timothy F. Martin, 1106 N. 21st, Boise, Id. 83702

[21] Appl. No.: 439,632

[22] Filed: May 12, 1995

[51] Int. Cl.[6] ..... A45F 4/02

[52] U.S. Cl. ..... 224/153; 224/581; 224/586; 224/634; 224/636; 224/640; 224/651; 224/652; 224/657; 224/664; 224/683; 224/921

[58] Field of Search ..... 224/153, 586, 224/575, 184, 630, 637, 640, 633, 634, 635, 636, 651, 652, 653, 657, 907, 921, 628, 629, 663, 664, 681, 682, 683, 677

[56] References Cited

U.S. PATENT DOCUMENTS

| | | | |
|---|---|---|---|
| 995,458 | 6/1911 | Harriman | 224/651 |
| 4,018,369 | 4/1977 | Jaeger | 224/586 |
| 4,518,107 | 5/1985 | Amos | 224/586 |
| 5,292,043 | 3/1994 | McHale | 224/210 |
| 5,320,262 | 8/1994 | Levis | 224/210 |
| 5,366,126 | 11/1994 | Dausien | 224/630 |
| 5,492,254 | 2/1996 | Challoner et al. | 224/586 |

FOREIGN PATENT DOCUMENTS

| | | | |
|---|---|---|---|
| 516153 | 12/1952 | France | 224/209 |

OTHER PUBLICATIONS

Pamphllet from Nimrod pack Systems including '95 Price Guide.

*Primary Examiner*—Linda J. Sholl
*Attorney, Agent, or Firm*—Joseph W. Holland

[57] ABSTRACT

A convertible pack frame which, in a first configuration allows the user to wear the pack simply around the waist or lower torso leaving the upper body unrestrained thereby facilitating the hunter's movement through and over rugged terrain and which in an alternate or second configuration may be used to lash or otherwise secure substantial loads including game for the purpose of transporting such loads. The convertible packing frame also provides a means for readily converting the system from a first configuration to a second configuration together with means for conveniently stowing those parts not required in the second configuration, i.e. the pack frame configuration, in a compartment provided when the apparatus is arranged in the first configuration.

8 Claims, 5 Drawing Sheets

10

CONVERTIBLE PACKING FRAME

BACKGROUND OF THE INVENTION

1. Technical Field

This invention relates in general to backpacks, and more particularly to a packing frame which may be converted from a waist or "fanny" pack to a frame for packing substantial loads.

2. Background

Hunters of big game may hike or otherwise travel for miles into remote areas stalking game. Many of the large game animals including deer, elk, moose, bear, mountain sheep and mountain goat inhabit areas which are characterized by remote, rugged and often times mountainous terrain. It is desirable and often necessary for the hunter to travel for extended periods of time tracking game in these types of areas and under the conditions presented therein. The demands of tracking game require that the hunter be able to move as quickly and as unencumbered as possible.

Once game is reduced to possession, a different set of conditions or problems arise, namely the need to pack the game out to the hunter's starting point. This task may involve the need for repeat trips to the site of the kill, each time removing a portion of the game. This task must be completed as rapidly as possible in order to avoid spoilage of the game.

It is well recognized that it is desirable for the hunter to be able to pack with him a few essentials for the hunt, i.e. water, food, first aid, extra clothing and other various and assorted necessities. However, a large pack or pack frame suitable for packing game out from the site of the kill is neither required for packing these few necessities, nor is it desirable simply because it restricts the hunter's ability to move quietly and quickly in an unencumbered fashion. What is needed is a convertible packing system which may be arranged initially as a "fanny" pack, that is a pack which is worn simply around the waist or lower torso having no shoulder straps. In a second configuration the apparatus converts to a pack frame capable of packing substantial loads.

At least one backpack system has been designed which demonstrates convertible features. In McHale, U.S. Pat. No. 5,292,043, a backpack is described which may be converted from a full sized pack with a large volume compartment capable of carrying loads of 70 pounds or more to a smaller climbing pack characterized by a smaller volume main compartment. The primary feature of the McHale invention is the compartment capable of defining at least two predetermined volumes. In either case however, the pack is secured to the user by a system of shoulder straps.

SUMMARY OF THE INVENTION

It is therefore an object of this invention to provide a convertible pack frame which in a first configuration would allow the user to wear the pack simply around the waist or lower torso leaving the upper body unrestrained thereby facilitating the hunter's movement through and over rugged terrain while providing storage for assorted necessities.

A second object of the present invention is to provide a convertible packing frame which in an alternate configuration may be used to lash or otherwise secure substantial loads including game for the purpose of transporting such loads.

A third object of the present invention is to provide a convertible packing frame which provides a means for readily converting the system from a first configuration to a second configuration together with means for conveniently stowing those parts not required in the second configuration, i.e. the pack frame configuration, in a compartment provided when the apparatus is arranged in the first configuration.

BEST MODE FOR CARRYING OUT INVENTION

Figure 1:
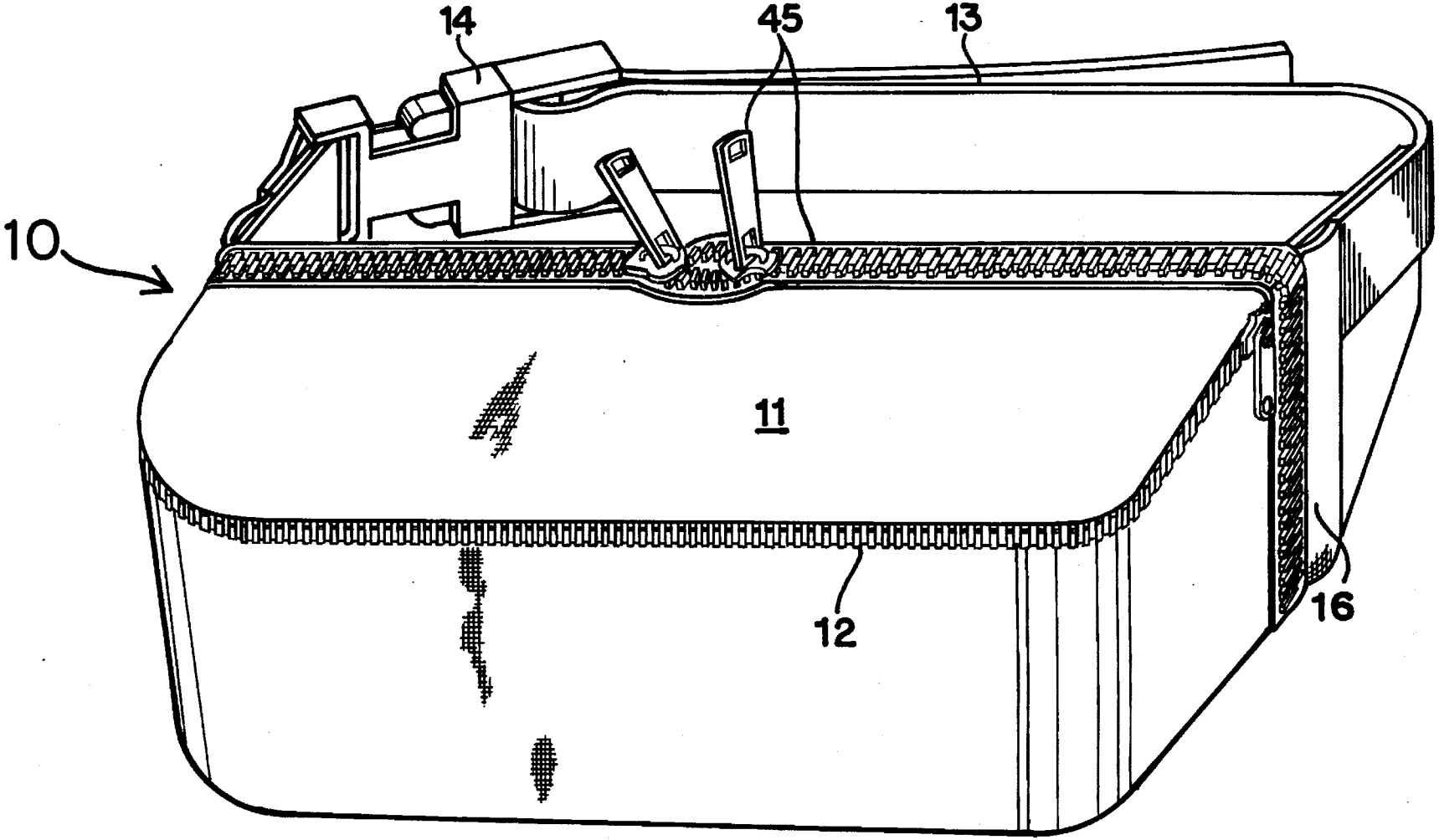
FIG. 1 is a perspective representational view of the convertible pack frame in a first configuration.
Figure 2:
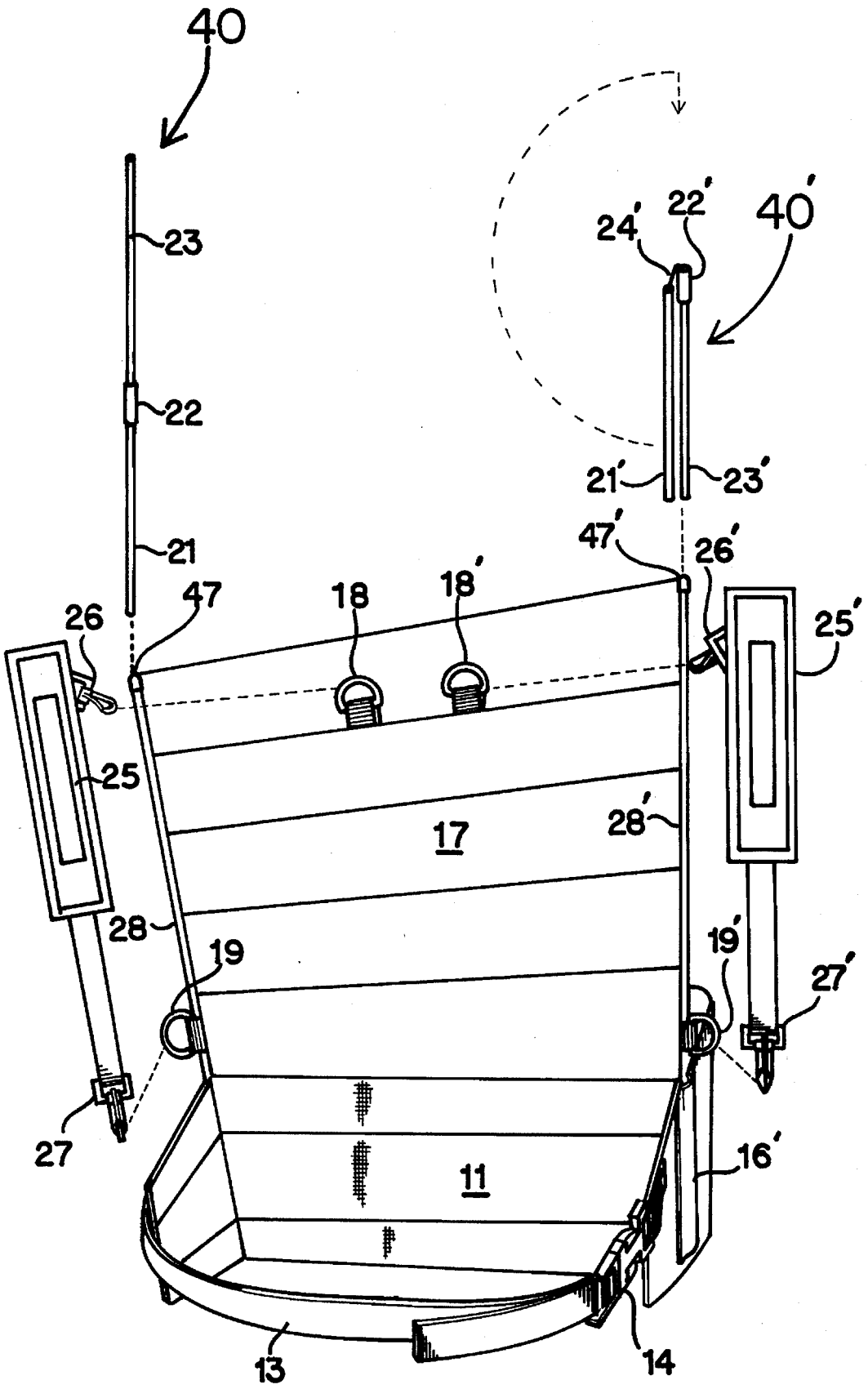
FIG. 2 is an exploded perspective representational view of the convertible pack frame showing the various components and their relationships to one another.
Figure 3:
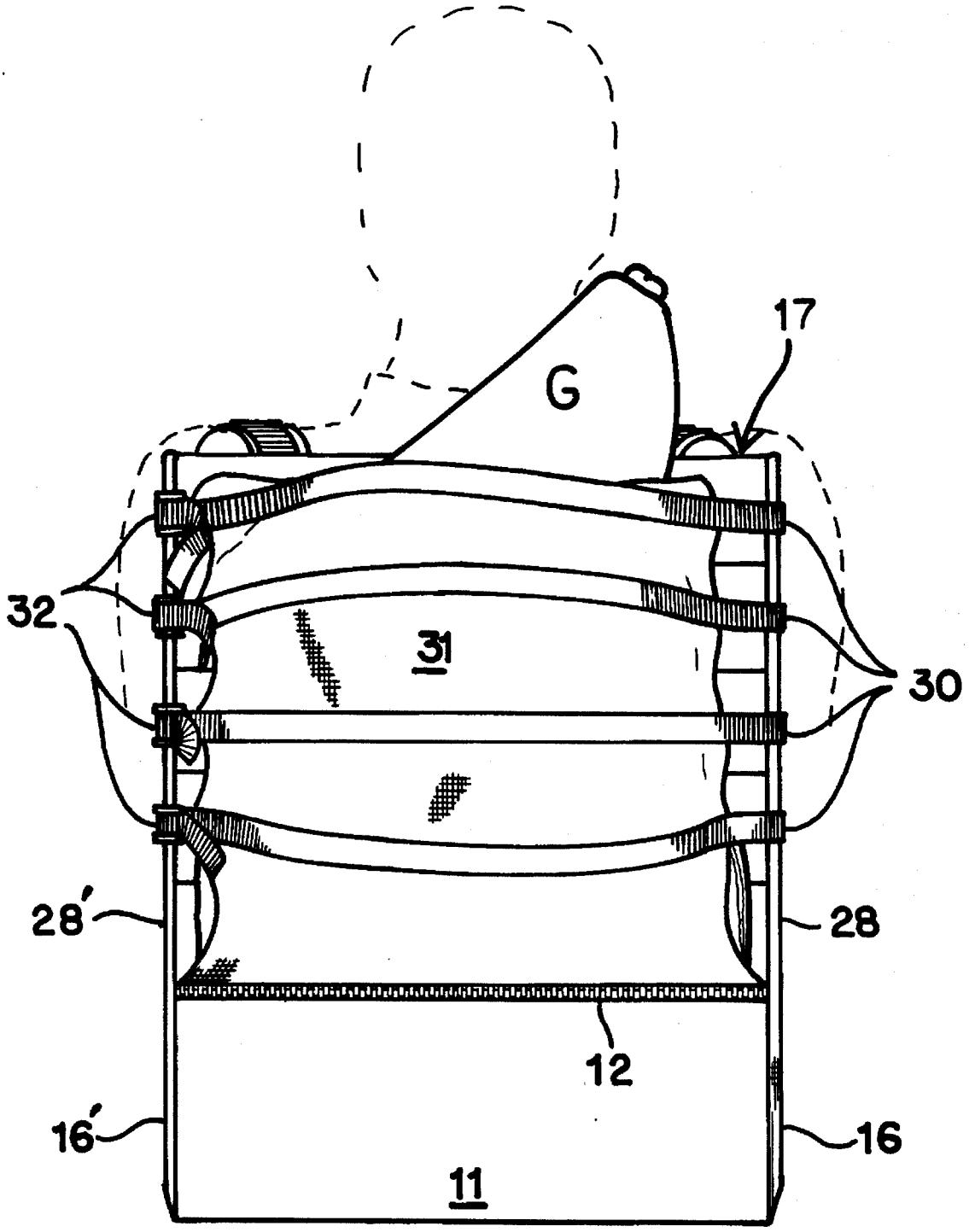
FIG. 3 is a rear representational view of the convertible pack frame in its second configuration.
Figure 4:
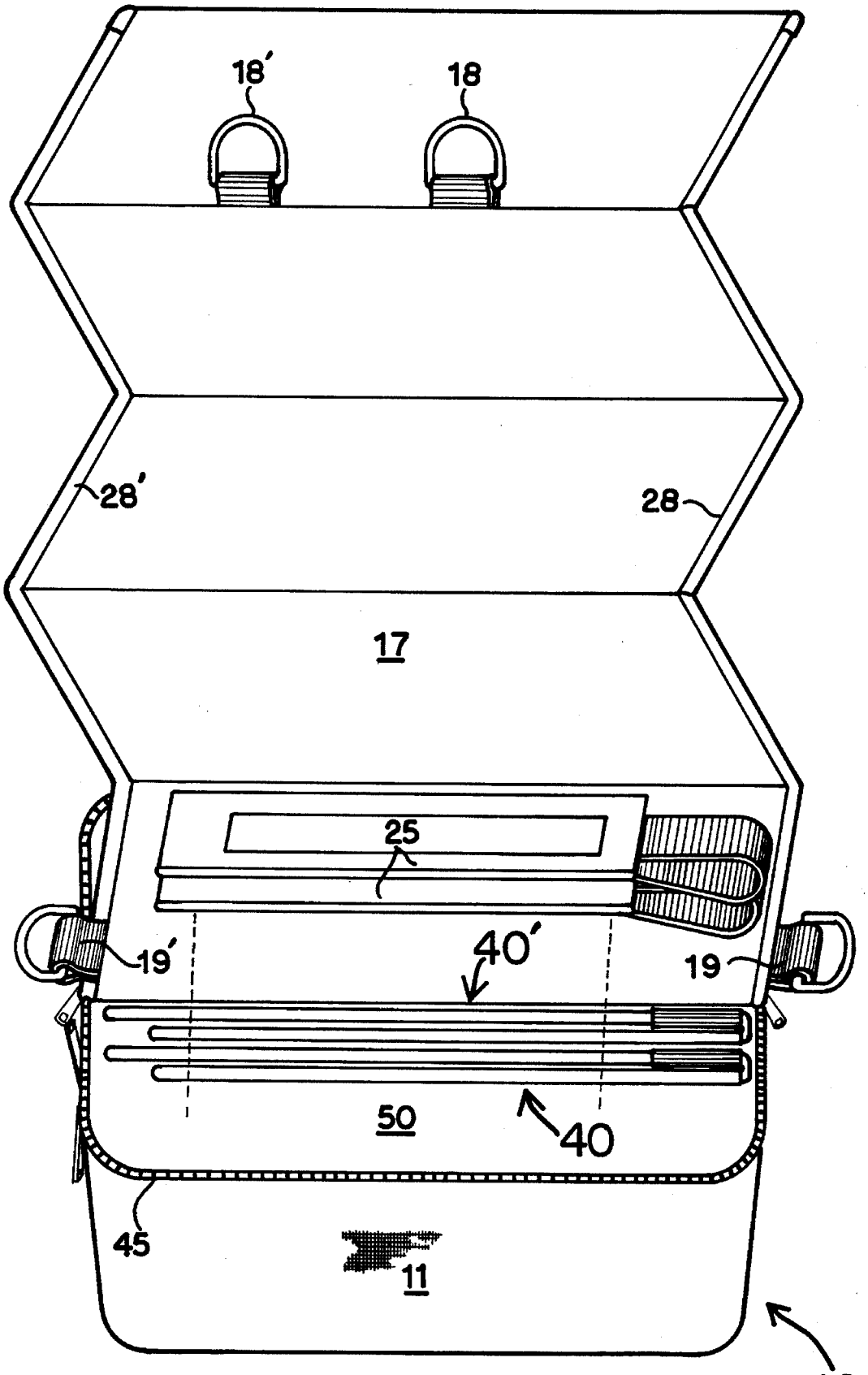
FIG. 4 is a rear representational view of the convertible packing frame demonstrating the stowable feature of the pack frame components when not in use.

Referring now to FIGS. 1 through 4 the preferred embodiment of the convertible pack frame 10 is shown to advantage. FIG. 1 is a perspective representational view of convertible pack frame 10 in a first configuration showing compartment 11 having closure means 12, belt means 13 with means for securing belt means 14. Stay support 16 is permanently affixed along the side of compartment 11. A similar stay support is located on the opposite side of compartment 11. Zipper 45 serves as a separate closure means to enclose storage compartment 50, as shown in FIG. 4.

FIG. 2 is an exploded representational view of the convertible pack frame 10 demonstrating a second, pack frame configuration. In the second configuration, back panel 17 is permanently attached to compartment 11.

Figure 5:
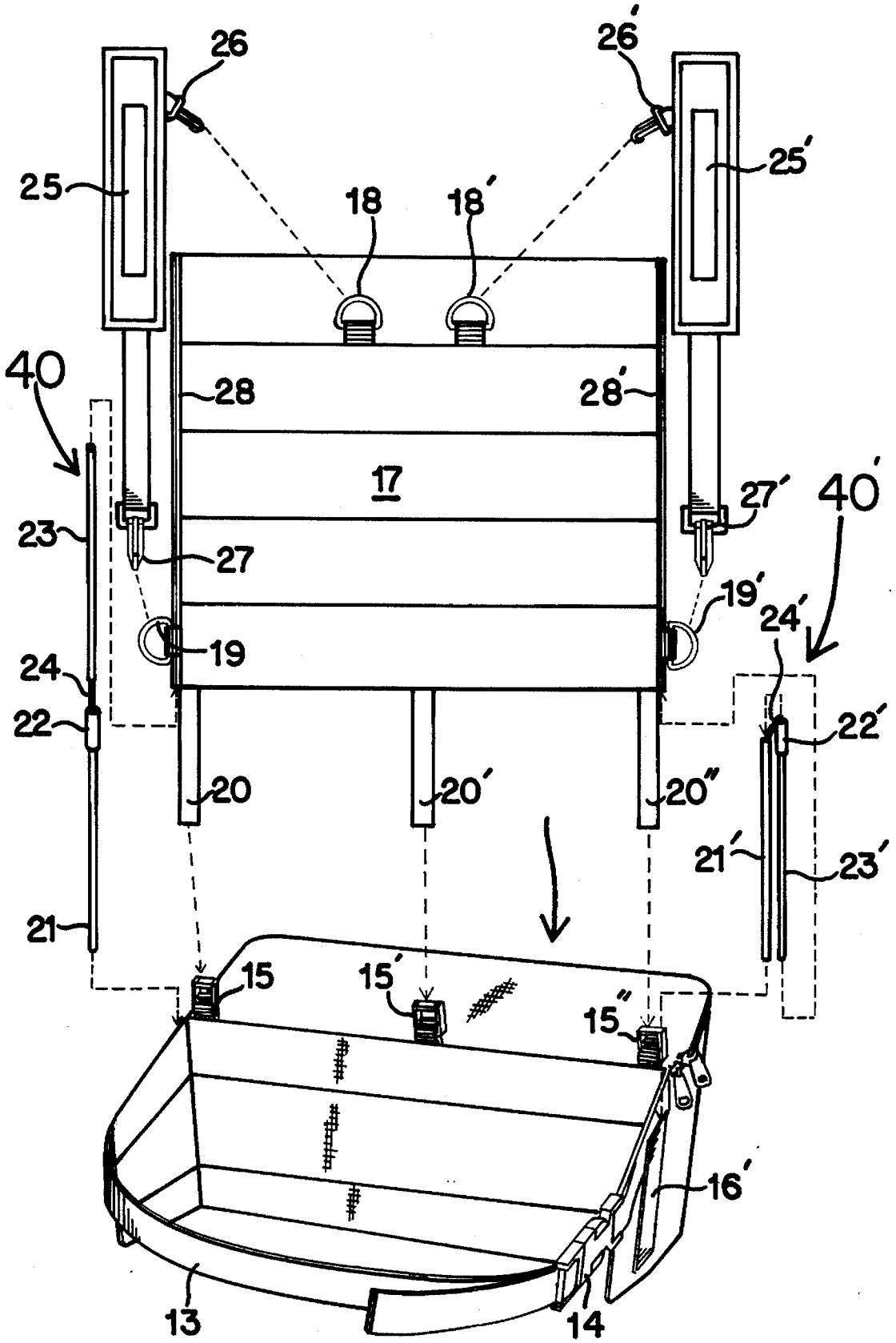
FIG. 5 is an exploded perspective representational view of an alternative embodiment of the convertible pack frame showing the various components and their relationships to one another.

FIG. 5 is an exploded representational view of an alternative embodiment of the convertible pack frame 10 demonstrating a second pack frame configuration. In the alternative configuration, back panel 17 is attached to compartment 11 by means of straps 20, 20' and 20", which correspond and connect with buckles 15, 15' and 15".

Referring to FIG. 4, back panel 17 is comprised of a fabric panel which has been sewn in such a manner as to form a plurality of horizontal compartments. Into each horizontal compartment a narrow thin plastic stiffener is placed and the ends of the compartment are sewn shut so that the plastic stiffeners remain inside the compartments. In this manner, foldable back panel 17 may be folded between the plurality of stiffening strips along the plurality of hinging means formed in the fabric between the enclosed plurality of stiffening strips into a compact configuration or in the alternative back panel 17 may be laid flat to serve as a back panel. FIG. 4 also shows to advantage storage compartment 50 which opens and closes by operation of zipper 45 to allow for storage of the various component parts needed to arrange the invention in a second configuration.

Referring to FIGS. 2 and 5, folding back panel 17 is maintained in a flat and rigid configuration, by structural means comprising foldable stay 40 and foldable stay 40'. Foldable stay 40 comprises first and second rigid tubular structural segments 21 and 23 and rigid tubular connector segment 22. Similarly, foldable stay 40' comprises rigid tubular structural segments 21' and 23' and rigid tubular connector segment 22'. Each of the foldable stays 40 and 40' are held together by an elastomeric cord 24 and 24' disposed and secured within the hollow core of the tubular segments.

Foldable back panel 17 is provided with vertical tubular channels 28 and 28' for receiving foldable stays 40 and 40'. In the preferred embodiment, vertical tubular channels 28 and 28' are opened at the top end for insertion of foldable stays 40 and 40' therein. Fabric flaps 47 and 47' keep foldable stays 40 and 40' from creeping out the top end vertical tubular channels 28 and 28'. In the alternative embodiment, vertical tubular channels 28 and 28' for receiving foldable stays 40 and 40' are open at their lower ends for insertion of foldable stays 40 and 40' therein and closed at the top end for retaining the foldable stay within the tubular channel. In either embodiment, foldable stays 40 and 40' are secured, at their lower ends, within stay support 16 and stay support 16'.

Foldable back panel 17 is further provided with shoulder strap connector rings 18, 18' and 19 and 19'. To these, attach shoulder straps 25 and 25' with corresponding connector means 26, 26', 27 and 27'.

Referring now to FIG. 3, the convertible pack frame is shown in use. Game G is placed against foldable back panel 17, covered by flap 31 and held secure by a plurality of straps 30 and buckles 32. The preferred embodiment has been utilized to pack loads in excess of 75 pounds securing the load as shown in FIG. 3.

FIG. 4 shows the manner in which the various components of convertible pack frame 10 may be folded in order to stow the same in compartment 50 while convertible pack frame 10 is used in the first configuration.

The convertible pack frame may be used in a first configuration as shown in FIG. 1. This configuration is suitable for wearing around an individual's waist, the device providing a compartment 11 for storing a few necessities during the hunt. Additionally, as shown in FIG. 4, compartment 50 is sized such that all the components for the convertible pack frame in the second configuration fit conveniently within compartment 50.

Referring to FIG. 2, it may be seen how convertible pack frame 10 is assembled for the second or alternate configuration. Foldable stays 40 and 40' are erected into their full length configuration by inserting one end of each of the rigid tubular structural segments 21, 23, 21' and 23' into one of the open ends of rigid tubular connector segments 22 and 22'. Foldable back panel 17 is unfolded to a flat configuration. Foldable stays 40 and 40' are inserted into vertical tubular channels 28 and 28'. The second end of foldable stays 40 and 40' are inserted into tubular channel 16 and 16' which are affixed to either side of belt means 13. Shoulder straps 25 and 25' are attached to foldable back panel 17 by securing clips 26, 26', 27 and 27' to D rings 18, 18', 19 and 19'.

Referring to FIG. 3, game or other substantial loads may be secured to convertible pack frame 10 by laying the load against back panel 17, closing flap 30 over the load and securing the same with straps 30 and buckles 32.

Referring to FIG. 4 it can be seen how the various components of convertible pack frame 10 may be readily stowed in compartment 11. Foldable back panel 17 is folded along it's plurality of hinging means so that back panel 17 forms a compact configuration. Similarly, foldable stays 40 and 40' are disassembled and folded in their alternative and more compact configuration. These elements together with shoulder straps 25 and 25' placed readily within compartment 11.

While there is shown and described the present preferred embodiment of the invention, it is to be distinctly understood that this invention is not limited thereto but may be variously embodied to practice within the scope of the following claims.

I claim:

1. A convertible pack frame comprising:

a belt having top and bottom edges and first and second ends;

a compartment attached to the belt, the compartment having top and bottom edges, a defined volume and a closure;

a foldable back panel having first and second side edges and top and bottom edges the foldable back panel bottom edge being attached to the belt top edge;

a first pair of vertical tubular channels having first and second ends, the first pair of vertical tubular channels being attached to the foldable back panel;

a pair of stay supports having open top ends and closed bottom ends, the pair of stay supports being attached to the belt and arranged in an in-line configuration with the first pair of vertical tubular channels attached to the foldable back panel;

a pair of foldable stays removably disposed within the first pair of vertical tubular channels attached to the foldable back panel and the pair of stay supports being attached to the belt;

a pair of shoulder straps, each shoulder strap having a first and a second end, each shoulder strap being removably attached to the foldable back panel; and means for removably attaching the pair of shoulder straps to the foldable back panel.

2. The convertible pack frame of claim 1 further comprising a storage compartment having a separate closure disposed between the belt and the compartment attached to the belt.

3. The convertible pack frame of claim 1 wherein the foldable back panel further comprises:

a plurality of horizontal compartments disposed within the foldable back panel;

a plurality of stiffeners disposed within the plurality horizontal compartments; and a plurality of hinging means disposed between the plurality of stiffeners disposed within the plurality of horizontal compartments such that the foldable back panel may be folded to a size and configuration that may be placed in the compartment attached to the belt for storage.

4. The convertible pack frame of claim 1 including means for removably attaching the foldable back panel to the belt top edge and further comprising:

a plurality of connectors attached to the back panel bottom edge; and a plurality of corresponding connectors attached to the belt top edge for corresponding connection to said plurality of connectors.

5. The convertible pack frame of claim 1 wherein the pair of foldable stays, removably disposed within the first pair of vertical tubular channels attached to the foldable back panel and the pair of stay supports being attached to the belt further comprises:

a plurality of rigid tubular structural segments, each of said rigid tubular structural segments having a first and a second end, a hollow core, an inside diameter and an outside diameter; and a plurality of rigid tubular connector segments, each of said rigid tubular connector segments having a first and a second end, a hollow core, an inside diameter and an outside diameter, the inside diameter of each rigid tubular connector segment being greater than the outside diameter of the rigid tubular structural segments, said rigid tubular connector segment having a constricted center section.

6. The convertible pack frame of claim 1 wherein the foldable back panel having first and second side edges and top and bottom edges is removably attached to the belt top edge.

7. The convertible pack frame of claim 5 wherein the pair of foldable stays, removably disposed within the first pair of vertical tubular channels attached to the foldable back panel and the pair of stay supports being attached to the belt further comprise:

an elastomeric cord disposed within the hollow core of a rigid tubular structural segment followed by a rigid tubular connector segment followed by a rigid tubular structural segment; and means for securing the elastomeric cord within the hollow core of each alternating rigid tubular connector segment and rigid tubular structural segments.

8. The convertible pack frame of claim 6 wherein the removably attached foldable back panel further comprises means for removably attaching the foldable back panel to the belt.

* * * * *